US011145954B2

(12) United States Patent
Tsai et al.

(10) Patent No.: US 11,145,954 B2
(45) Date of Patent: Oct. 12, 2021

(54) ANTENNA FOR A COMMUNICATION DEVICE

(71) Applicant: HEWLETT-PACKARD DEVELOPMENT COMPANY, L.P., Houston, TX (US)

(72) Inventors: Ming-Shien Tsai, Taipei (TW); Leo Joseph Gerten, Austin, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 313 days.

(21) Appl. No.: 16/092,090

(22) PCT Filed: Jul. 29, 2016

(86) PCT No.: PCT/US2016/044794
§ 371 (c)(1),
(2) Date: Oct. 8, 2018

(87) PCT Pub. No.: WO2018/022100
PCT Pub. Date: Feb. 1, 2018

(65) Prior Publication Data

US 2019/0165451 A1 May 30, 2019

(51) Int. Cl.
*H01Q 1/38* (2006.01)
*H01Q 1/24* (2006.01)
*H01Q 9/42* (2006.01)

(52) U.S. Cl.
CPC ..... *H01Q 1/243* (2013.01); *H01Q 1/38* (2013.01); *H01Q 9/42* (2013.01)

(58) Field of Classification Search
CPC ..... H01Q 1/24; H01Q 1/38; H01Q 9/42
USPC ..... 343/700 MS
See application file for complete search history.

(56) References Cited

U.S. PATENT DOCUMENTS 8,648,752 B2 2/2014 Ramachandran et al.
8,654,024 B2 * 2/2014 Chou ..... H01Q 1/243 343/749
8,754,817 B1 * 6/2014 Kuo ..... H01Q 5/371 343/702
2004/0233111 A1 * 11/2004 Desclos ..... H01Q 9/28 343/700 MS
2004/0246188 A1 12/2004 Egashira
(Continued)

FOREIGN PATENT DOCUMENTS

CN 1705164 12/2005
CN 102684726 9/2012
(Continued)

OTHER PUBLICATIONS

Eom, S., et al., Embedded Antenna for Metallic Handheld Communication Devices, Jan. 2014, <http://www.jpier.org/PIERB/pierb57/09.13101107.pdf>.

*Primary Examiner* — Andrea Lindgren Baltzell
(74) *Attorney, Agent, or Firm* — HPI Patent Department

(57) ABSTRACT

Examples relating to an antenna for a communication device are described. In one example, the antenna may include a longitudinally extending base strip, and a radiating strip. The radiating strip extends longitudinally with respect to the base strip. The antenna may further include a coupling strip which provides a conducting path between the base strip and the radiating strip. The radiating strip is such that its length is greater than length of the base strip.

14 Claims, 6 Drawing Sheets

(56) References Cited

U.S. PATENT DOCUMENTS

| | | | | |
|---|---|---|---|---|
| 2005/0088351 | A1 | 4/2005 | Tai et al. | |
| 2010/0060528 | A1 | 3/2010 | Chiu et al. | |
| 2011/0206097 | A1 | 8/2011 | Darden, IV | |
| 2012/0026046 | A1 * | 2/2012 | Bit-Babik ..... | H01Q 9/0421 343/702 |
| 2012/0235866 | A1 | 9/2012 | Kim et al. | |
| 2013/0229313 | A1 | 9/2013 | Chiu | |
| 2013/0249764 | A1 | 9/2013 | Amaya | |
| 2015/0303552 | A1 | 10/2015 | Su et al. | |

FOREIGN PATENT DOCUMENTS

| | | | |
|---|---|---|---|
| CN | 102842748 | | 12/2012 |
| CN | 104362427 | A | 2/2015 |
| CN | 205069848 | U | 3/2016 |
| CN | 205122767 | U | 3/2016 |
| WO | WO-2015156606 | A1 | 10/2015 |
| WO | WO-2016015284 | | 2/2016 |

* cited by examiner

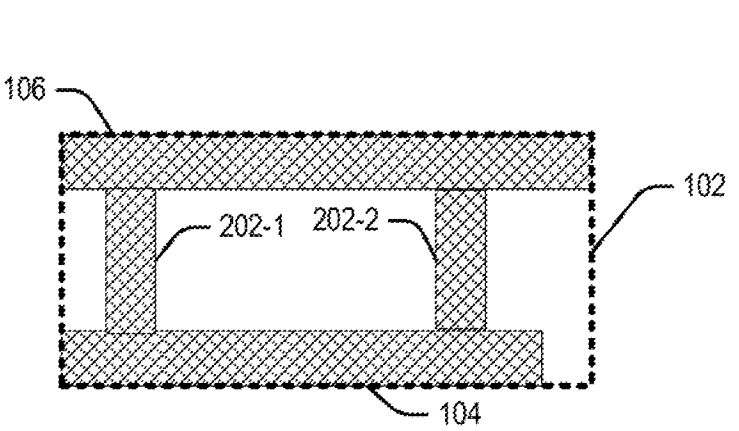
FIG. 2A
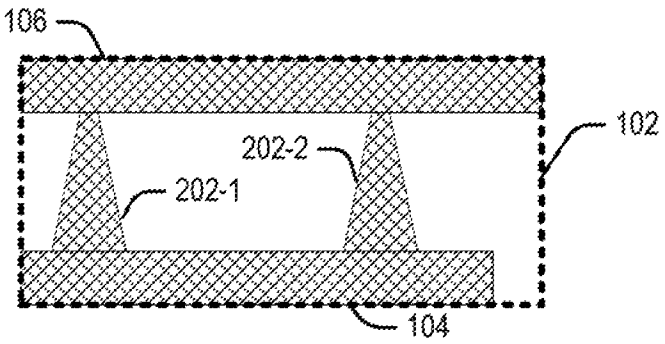
FIG. 2B
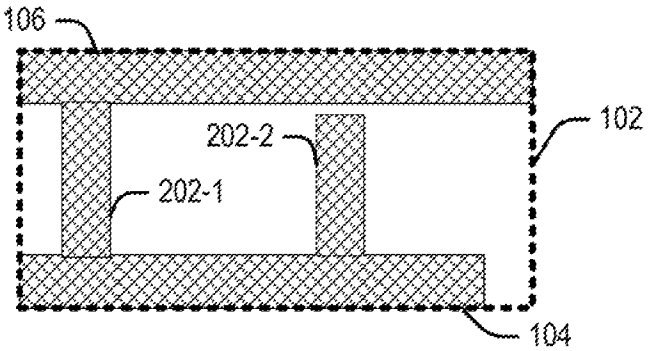
FIG. 2C
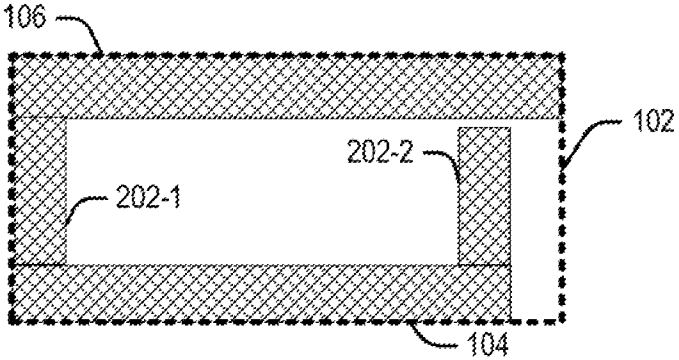
FIG. 2D
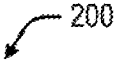

ANTENNA FOR A COMMUNICATION DEVICE

BACKGROUND

Communication devices like cellular phones utilize their antennas for wireless communication with radio access networks. Similarly, computing devices such as laptops or handheld computers may also include an antenna for connecting to wireless networks, such as Wi-Fi. Designs of such communication devices are ever changing, and correspondingly, the design of the antennas also changes with changes in design of such communication devices.

BRIEF DESCRIPTION OF DRAWINGS

The detailed description is provided with reference to the accompanying figures. In the figures, the left-most digit(s) of a reference number identifies the figure in which the reference number first appears. The same numbers are used throughout the drawings to reference like features and components.

FIGS. 2A-2D illustrate various examples of antenna having a plurality of coupling strips;

DETAILED DESCRIPTION

Figure 1:
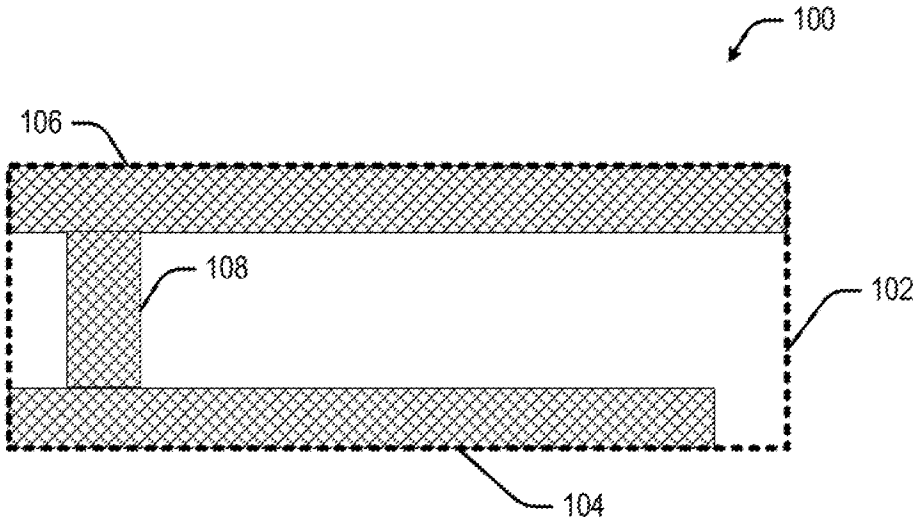
FIG. 1 illustrates an example antenna for communication devices.

The present subject matter relates to antenna in communication devices or other electronic devices, such as desktop computers, laptops, smart phones, smart televisions, personal digital assistants (PDAs), tablets, portable gaming devices, all-in-one computers, and the like. As would be understood, designs of electronic communication devices (also referred to as electronic devices) have been evolving. More recent types of the communication devices are thinner and have a sleeker form factor. Furthermore, such thin communication devices may commonly include a metallic chassis for supporting various internal components and electronic circuitry within the device, as well as for improving the aesthetic appeal of such devices. The communication devices may include a radio frequency antenna (referred to as an antenna) that allows communication with one or more other devices through a wireless network or through a telecommunication network, via radio frequency transmission.

For such communication devices, the RF antenna may be implemented with a radiating element of the RF antenna being positioned at a specific vertical distance from a ground plane of the RF antenna. Due to the reducing size and slimmer form factors of the communication devices, the specific vertical distance is no longer available thereby limiting the RF transmission. This may, in turn, affect the operation of RF antenna. In cases where the body of the communication device is metallic, the extent and effectivity of the antenna to carry out RF transmission may also get affected as metal may not be transparent to, or effectively act as a shield for RF transmission. As a result, the metallic chassis may reduce the extent to which the antenna may carry out RF transmission.

Generally, cut-outs may be introduced in portions of the metallic chassis that cover the RF antenna. Such cut-outs may then be covered with non-metallic material, such as plastic or glass. However, using non-metallic portions interspersed with metallic portions may affect the structural robustness of the electronic device due to multiple contiguous portions of metallic and non-metallic materials, and may also impact the aesthetic appeal of the article.

Examples of antenna and communication devices incorporating such antenna are described. The described antenna, as will be explained, may provide optimum performance in communication devices having a metallic chassis. The described antenna provides improved radiation performance through the metal chassis without utilizing cut-outs, and is capable of operating at different frequency bands, thereby increasing the flexibility of operating at different environment conditions. It should be noted that the term communication device is to be construed generally. Communication device may include any device with electronic or electrical circuitry which may communicate over a wireless network or over a wireless telecommunication network.

In one example, the antenna may be implemented on a substrate such as a printed circuit board (PCB). For implementing the antenna, at least two longitudinally extending strips, namely a base strip and a radiating strip, may be provided. In one example, the base strip may be a ground plane that is patterned or etched as a feeding strip on the substrate. The ground plane can be a conducting surface which is connected to a transceiver and serves as a reflecting surface to reflect radio waves received from other antennas. Further, as described above, the ground plane is required to be at a specific vertical distance from the radiating strip so as to radiate in desired bandwidth. Accordingly, the base strip and the radiating strip may be disposed parallel to each other and at a specific vertical distance.

The radiating strip may be considered as a radiating component of the antenna. The radiating strip may be electrically coupled to the base strip through one or more coupling strips. The coupling strip may provide a shorting path or a shorting pin for providing an electrically conductive connection between the base strip and the radiating strip. The coupling strip may be disposed orthogonal to the radiating strip and the base strip.

In another example implementation, the described antenna when deployed, is so positioned that the radiating strip of the antenna is between 0.1-0.5 mm away from the surface of the metallic chassis of the communication device. The spacing between the radiating strip and the metallic surface acts as a capacitor. In operation, the radiating strip of the antenna is in a capacitive coupling with the surface of the metallic chassis for affecting radio frequency transmission. As a result of the coupling between the radiating strip and the metallic surface of the chassis, the metallic surface may also be excited to act as a radio wave radiating element. In yet another example implementation, the radiating strip is longer than the base strip. By having the long radiating strip, the radiating strip may be able to provide uniform capacitive coupling effect along with the metallic chassis. In one example, the antenna as described may include multiple coupling strips positioned between the radiating strip and the base strip. The multiple coupling strips may further enable the antenna to operate for multiple frequencies.

The above described subject matter is further described with reference to FIGS. 1-6. It should be noted that that the description and the figures merely illustrate the principles of the present subject matter along with examples described herein, and should not be construed as a limitation to the present subject matter. It is thus understood that various arrangements may be devised that, although not explicitly described or shown herein, embody the principles of the present subject matter. Moreover, all the statements herein reciting principles, aspects, and implementations of the present subject matter, as well as specific examples thereof, are intended to encompass equivalents thereof.

FIG. 1 provides an example of an antenna 100. In this example, the antenna 100 may be implemented onto a substrate 102 (as represented by a dotted line). In such cases, the antenna 100 may be provided by way of etching onto the substrate 102. An example of the substrate 102 includes, but is not limited to, a printed circuit board (PCB). The antenna 100 may further include a longitudinally extending base strip 104, along with a radiating strip 106, also extending longitudinally with respect to the base strip 104. In said example implementation, the base strip 104 and the radiating strip 106 may be disposed parallel to each other and at a specific vertical distance of about 2 mm. It should be noted that the distance is only illustrative and may vary depending on the frequency in which the antenna 100 operates. Other distance measures may also be included within the scope of the present subject matter.

Continuing with the present description, the base strip 104 and the radiating strip 106 may be coupled with a conductive path provided by a coupling strip 108. The coupling strip 108 may be rectangular in shape, or may be of any shape, without affecting the scope of the present subject matter. The antenna 100 as illustrated may be deployed within a metallic chassis of a communication device. When deployed, it is so positioned such that the radiating strip 106 lies about 0.1-0.5 mm from the surface of the metallic chassis. As would be discussed in conjunction with the remaining figures, in operation the radiating strip 106 is capacitively coupled with the surface of the metallic chassis for affecting RF transmission. The spacing between the radiating strip 106 and the metallic surface (not shown in FIG. 1) acts as a capacitor. In operation, the radiating strip 106 of the antenna 100 results in a capacitive coupling with the surface of the metallic chassis for affecting radio frequency transmission. As a result of the coupling between the radiating strip 106 and the metallic surface of the chassis, the metallic surface is also excited to act as a radio wave radiating element.

In one example, the antenna 100 may include multiple coupling strips, such as the coupling strip 108. FIGS. 2A-2D illustrate further examples in which antenna 200 may include additional coupling strips. For example, FIG. 2A depicts antenna 200 having two coupling strips 202-1 and 2 (collectively referred to as the coupling strips 202). The coupling strips 202 as illustrated in FIG. 2A provide a plurality of feed points for inputting electric energy intended for transmission through the radiating strip 106. The coupling strips 202 may be arranged at specific intervals in longitudinal direction of the radiating strip 106 depending on the operating frequency. In said example implementation, the plurality of feed points may be two feed points which are fed by two coupling strips 202-1 and 202-2. The coupling strips 202-1 and 202-2 may be directly coupled with the radiating strip 202-1 at one end and with the base strip 104 at another end. In one example, the dimensions of the coupling strips 202 may also vary without deviating from the scope of the present subject matter.

The shape of the coupling strips 202 may also vary. For example, FIG. 2B indicates that the coupling strips 202 are trapezoidal in shape. As can be seen from the figures, the coupling strips 202 are broader at the point of contact with the base strip 104 and narrower at the point of contact with the radiating strip 106. The coupling strips 202 may also be such that the point of contact with the base strip 104 is narrower as compared to the point of contact with the radiating strip 106. In other examples, other non-uniform shapes, such as rhomboidal, may also be used without limiting the scope of the present subject matter.

In one example, the coupling strips 202 may be of different lengths. In such cases, one of the coupling strips 202, say the coupling strip 202-1, may be in contact with both the radiating strip 106 and the base strip 104. The other coupling strip 202-2 is such that it may extend laterally from the base strip 104 towards the radiating strip 106, but does not form a contact with the radiating strip 106. By having such varying contacts along the longitudinal length of the radiating strip 106, operating frequency of the antenna may be varied by feeding different level of electrical energy for RF transmission. In another example, the non-contacting coupling strip 202-2 may be positioned at the end of the base strip 104 (as shown in FIG. 2D). In yet another example, the coupling strips 202 may be of a variety of non-linear shapes, such as coils. In each of such cases, the antenna 200 may be deployed in a communication device (as explained in conjunction with FIG. 4). When deployed, the antenna 200 may be so positioned within the metallic chassis, so that the radiating strip 106 is in close proximity with the inner portion of the metallic chassis. In one example, the spacing between the radiating strip 106 and the surface of the metallic chassis is in the range of about 0.1-0.5 mm. The spacing between the radiating strip 106 and the metallic surface (illustrated in FIG. 4) acts as a capacitor. In operation, the radiating strip 106 of the antenna 200 results in a capacitive coupling with the surface of the metallic chassis for affecting radio frequency transmission. As a result of the coupling between the radiating strip 106 and the metallic surface of the chassis, the metallic surface is also excited to act as a radio wave radiating element.

In yet another example, the antenna may further include intermediate portions interspersed between the radiating strip 106 and the base strip 104. The intermediate portion is intended for further contributing the extent of capacitive coupling between the radiating strip 106 and the surface of the metallic chassis. The intermediate portion may be of specific share and dimension, which in turn may be determined based on the frequency within the antenna (e.g., the antenna 300), would be operating at. For example, FIG. 3A depicts an example antenna 300. The antenna 300 includes the base strip 104 and the radiating strip 106. The antenna 300 includes an intermediate portion 302 present between the radiating strip 106 and the base strip 104.

As illustrated, the intermediate portion 302 is L-shaped, including a laterally extending and a longitudinally extending portion. The laterally extending portion extends from the point of contact of the intermediate portion 302 from the base strip 104. Further, the longitudinally extending portion extends from the other end of the laterally extending portion in a direction along the direction of the radiating strip 106. The intermediate portion 302 as indicated further enhances the capacitive coupling of the radiating strip 106 with the metallic chassis (not shown in FIG. 3A).

Figure 3B:
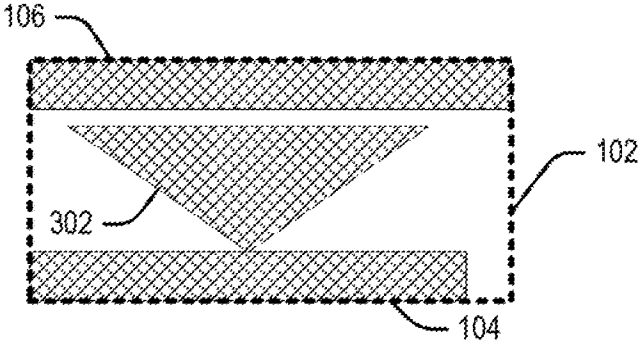
FIGS. 3A-3C illustrate various examples of antenna having an intermediate strip.
Figure 3A:
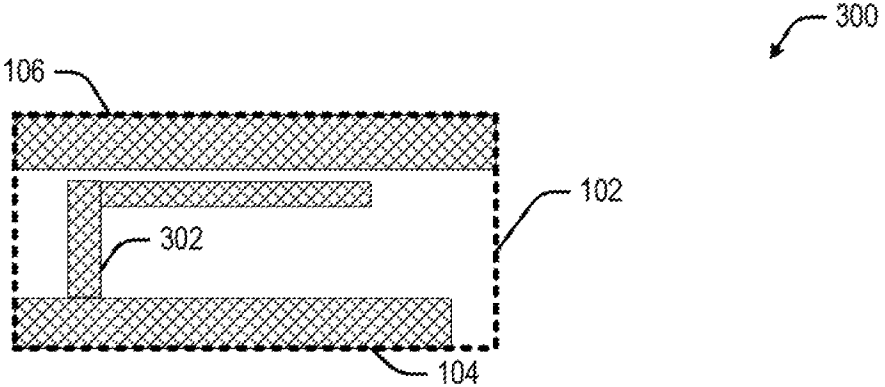
Figure 3C:
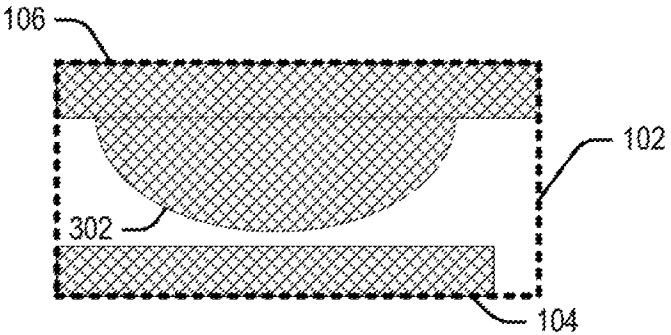

Other examples of the intermediate portion 302 are also depicted in FIGS. 3B-3C, in which the intermediate portion 302 is of a different shape. In FIG. 3B, the intermediate portion 302 is such that that one edge of the intermediate portion 302 is proximal to the radiating strip 106, while an end proximal to the base strip 104 converges to a point on the base strip 104 to provide a triangular shaped intermediate portion 302. In another example, the intermediate portion 302 is semi-circular in shape, with the linear surface adjacent to the radiating strip 106, and an arced surface of the intermediate portion 302 lies proximal to the radiating strip 106 (FIG. 3C).

Figure 4:
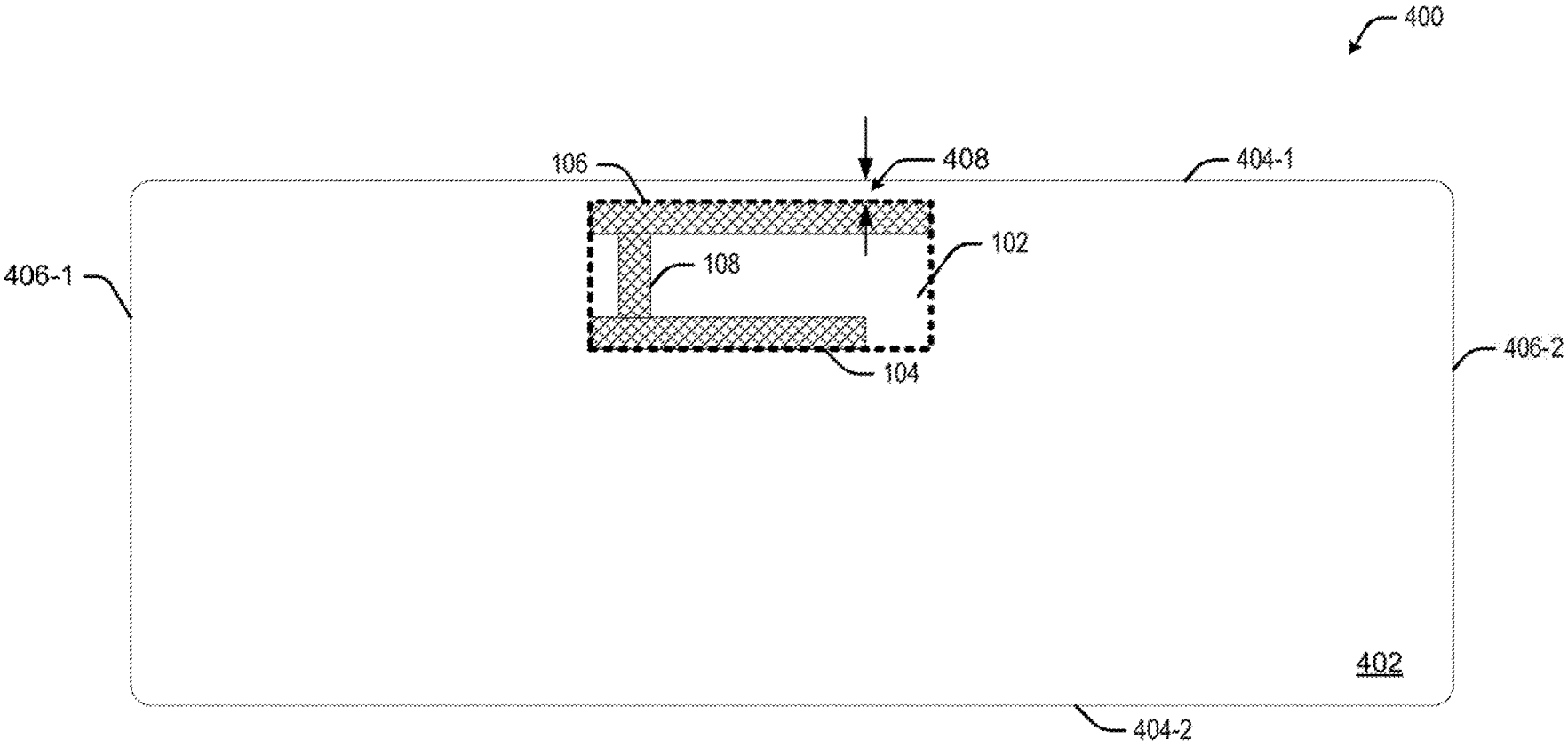
FIG. 4 illustrates a communication device implementing an example antenna.

FIG. 4 represents an example communication device 400 housing the antenna 100. The communication device 400, shown in FIG. 2, is merely illustrative. The communication device 400 may be a stationary device or a portable device. The communication device 400 may include, but are not restricted to, desktop computers, laptops, smart phones, smart televisions, personal digital assistants (PDAs), tablets, gaming devices, all-in-one computers, and the like.

In an example implementation, the communication device 400 may include chassis 402 to support and hold internal components, electrical and electronic circuitry of the communication device 400. The chassis 402 may be made of metal capable of conducting and radiating electric and magnetic energy. In an example, the metallic chassis 402 may include longitudinal surfaces 404-1 and 2, and lateral surfaces 406-1 and 2.

As described above, the antenna 100 may include the base strip 104, and the radiating strip 106 extending longitudinally with respect to the base strip 104. In an example, the base strip 104 and the radiating strip 106 may be disposed parallel to each other and at a specific vertical distance of about 2 mm. It should be noted that the distance is only illustrative and may vary depending on the frequency in which the antenna 100 operates. Other distance measures may also be included within the scope of the present subject matter.

Returning to the present description, the base strip 104 and the radiating strip 106 may be coupled with a conductive path provided by a coupling strip 108. The coupling strip 108 may be rectangular in shape, or may be of any shape without affecting the scope of the present subject matter. The antenna 100 as indicated may be deployed within the metallic chassis 402 of the communication device 400.

In an example implementation, when deployed, the radiating strip 106 may be disposed at a specific distance 408 from a surface, say, the longitudinal surface 404-1, of the metallic chassis 402. In an example, the specific distance 408 between the radiating strip 106 and the longitudinal surface 404-1 may be selected from a range of 0.1-0.5 mm, based on the frequency band to be radiated by the antenna 100.

In one example, the radiating strip 106 may be spaced apart by about 0.5 mm from the longitudinal surface 404-1 of the metallic chassis 402. In said example, the specific distance 212 may provide an efficient capacitive coupling of the radiating strip 106 with the metallic chassis 402. Due to the capacitive coupling, the antenna 100 may feed radio frequency energy to the longitudinal surface 404-1 of the metallic chassis 402 so that the metallic chassis 402 can act as an antenna radiator during operation of the antenna 100. As would be understood, the radiating strip 106 of the antenna 100 is in close proximity with the longitudinal surface 404-1 defining the inner portion of the chassis, as a result of which the radiating strip 106 and the longitudinal surface 404-1 act as a capacitor. In operation, the radiating strip 106 of the antenna results in a capacitive coupling with the longitudinal surface 404-1 for affecting radio frequency transmission. As a result of the coupling between the radiating strip 106 and the longitudinal surface 404-1, the metallic surface is also excited to act as a radio wave radiating element Accordingly, by enabling the longitudinal surface 404-1 to act as the antenna radiator, the radiation efficiency of the antenna 100 may be significantly improved as the metallic chassis 402 may not act as barrier for radiations. Further, since no cut-outs are to be made on the metallic chassis 402 due to the described arrangement of the antenna 100 in the communication device 400, the robustness and aesthetic appearance of the communication device 400 may be enhanced.

Figure 5A:
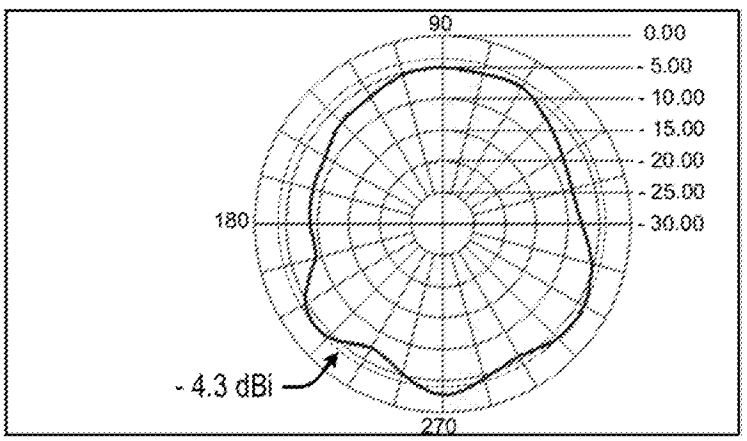
FIGS. 5A-5C illustrate radiation patterns for an example antenna.
Figure 5B:
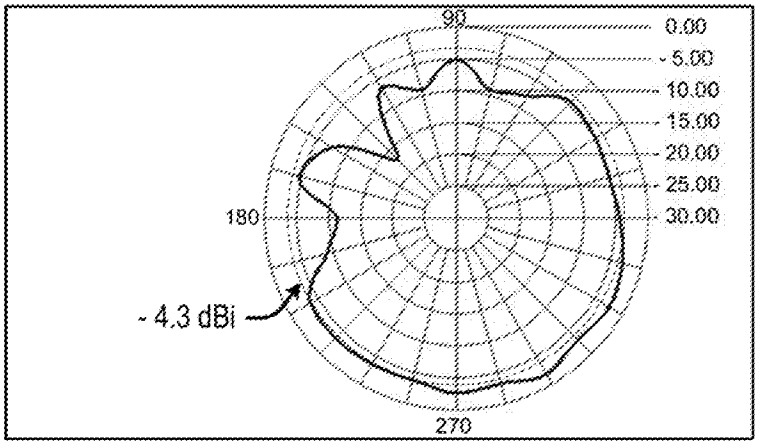
Figure 5C:
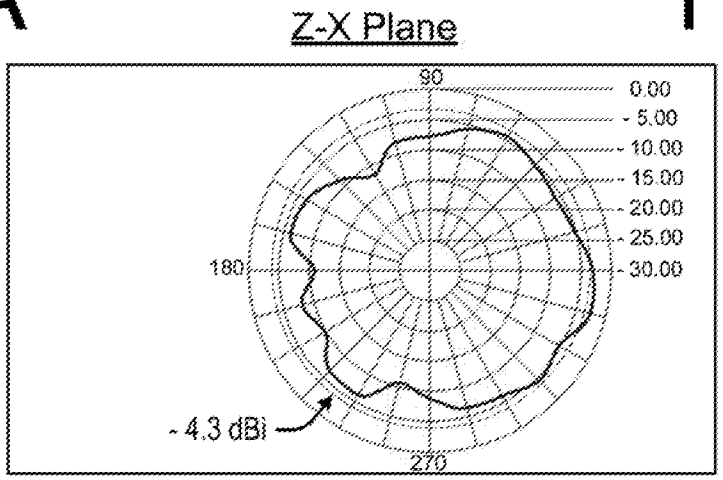

FIGS. 5A-5C illustrate the radiation patterns obtained for one of the example antennae. As would be understood, the radiation pattern depicts the relation of the strength of the radio wave with respect to direction. In the present set of patterns, FIGS. 5A-5C depict the radiation patterns in the X-Y, Y-Z, and X-Z planes, respectively. For the present example, the length of radiating strip 106 may be in the range of 20-50 mm in length. In an example, the antenna 100 yields an antenna gain of about −4.3 dBi at operating frequency of 2.4 GHz. In an example, the measured test results for 2.4 GHz operating frequency demonstrate a good omnidirectional radiation pattern in Y-Z plane.

In the examples depicted in FIGS. 5A-5C, the length of radiating strip 106 may be in the range of 20-50 mm in length. As illustrated, the antenna 100 yields an antenna gain of about −4.3 dBi at operating frequency of about 2.4-2.5 GHz. Antenna gain is generally considered to provide an indication as a key performance element which combines antenna's directivity and radiating efficiency. It also depicts as to how efficiently an antenna, such as antenna 100, may convert input power into radio waves in a specified direction. Also, when no direction is specified, the antenna gain is understood as peak value of the antenna gain or peak gain.

In an example, a plot of the antenna gain as a function of direction is referred to as the radiation pattern. For example, in FIG. 5A, a radiation pattern may plot the antenna gain in the X-Y plane resulting from a single example antenna, say, the antenna 100, positioned horizontally in the X-Y plane. Due to the horizontal position of the antenna 100, the radiation pattern may extend perpendicular with respect to the antenna 100. As shown, the antenna 100 alone yields approximately −4.3 dBi antenna gain and approximately −2.70 dBi peak gain at 2400 MHz frequency in X-Y plane.

Similarly, in another example shown in FIG. 5B, the antenna 100 may be positioned horizontally against the Y-Z plane. In said example, directional radiation pattern resulting from horizontal position of the antenna 100 may extend perpendicular with respect to the antenna 100. With such radiation pattern, the antenna 100 may yield approximately −4.3 dBi antenna gain and approximately −1.181 dBi peak gain at 2400 MHz frequency in Y-Z plane.

In yet another example shown in FIG. 5C, the antenna 100 may be positioned in a vertical and upright position against the Z-X plane. In said example, the directional radiation pattern may extend horizontally with respect to the position of the antenna 100. With such radiation pattern, the antenna 100 may yield approximately −4.3 dBi antenna gain and approximately −2.54 dBi peak gain at 2400 MHz frequency in Y-Z plane. Accordingly, as can be seen from FIGS. 5A-5C, the measured test results for 2.4 GHz operating frequency demonstrate efficient omnidirectional radiation patterns in Y-Z plane.

Figure 6A:
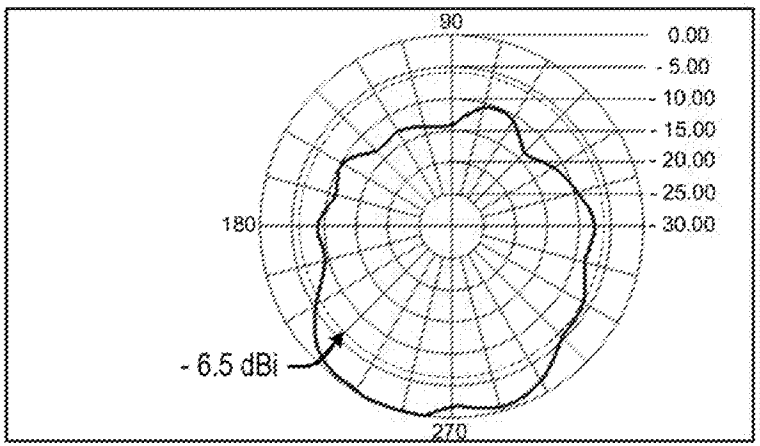
FIGS. 6A-6C illustrate radiation patterns for another example antenna.
Figure 6B:
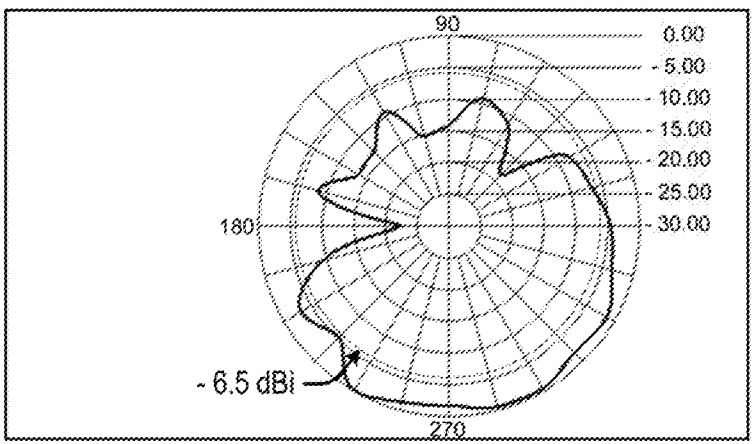
Figure 6C:
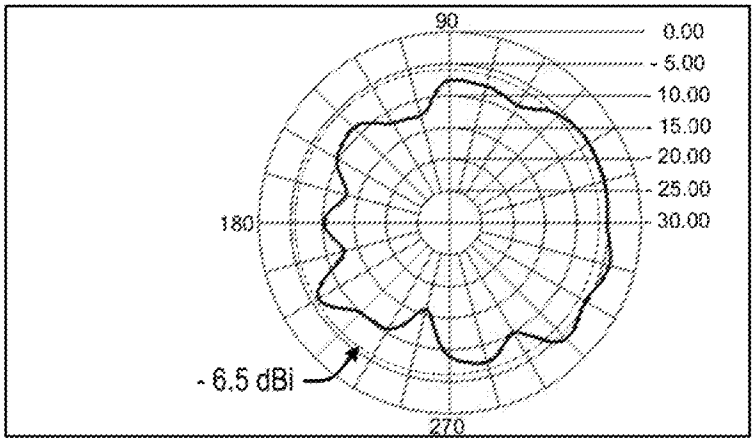

FIGS. 6A-6C illustrate the measured test results of the antenna radiation patterns, in the planes X-Y, Y-Z, and X-Z, respectively, when the described antenna 100 having a radiating strip 106 of 75-150 mm length may be operated. In an example, the antenna 100 yields an antenna gain of about −6.5 dBi at operating frequency of 5 GHz ranges.

In an example shown in FIG. 6A, a radiation pattern may plot the antenna gain in the X-Y plane resulting from the antenna 100 positioned horizontally in the X-Y plane. Due to the horizontal position, the radiation pattern from the antenna 100 may extend perpendicular with respect to the antenna 100. As shown, the antenna 100 alone yields approximately −6.5 dBi antenna gain and approximately −1.52 dBi peak gain at 5150 MHz frequency in X-Y plane.

Similarly, in another example shown in FIG. 6B, the antenna 100 may be positioned horizontally against the Y-Z plane, and radiation pattern resulting from the antenna 100 may extend perpendicular with respect to the antenna 100. With such radiation pattern, the antenna 100 may yield approximately −6.5 dBi antenna gain and approximately −0.03 dBi peak gain at 5150 MHz frequency in Y-Z plane.

In yet another example shown in FIG. 6C, the antenna 100 may be positioned in a vertical and upright position against the Z-X plane. In said example, the directional radiation pattern may extend horizontally with respect to the position of the antenna 100. With such radiation pattern, the antenna 100 may yield approximately −4.3 dBi antenna gain and approximately −4.02 dBi peak gain at 5150 MHz frequency in Y-Z plane.

As can be seen from FIGS. 6A-6C, the measured test results for 5 GHz operating frequency demonstrate an efficient omnidirectional radiation pattern in Y-Z plane for a frequency 5150 MHz. Accordingly, the presence of the antenna 100 in the proximity of the metallic chassis 402 provides better performance even in all metal designs of the communication device 400 by enhancing radiation, frequency, and bandwidth performances of the antenna 100.

Although the implementations of the present subject matter have been described in language specific to structural features and/or methods, it is to be understood that the present subject matter is not limited to the specific features or methods described. Rather, the specific features and methods are disclosed and explained in the context of a few implementations for the present subject matter.

We claim:

1. An antenna for a communication device, the antenna comprising:
- a longitudinally extending base strip;
- a radiating strip, extending longitudinally with respect to the base strip; and
- a coupling strip providing a conducting path between the base strip and the radiating strip,
- wherein length of the radiating strip is greater than length of the base strip,
- wherein the coupling strip is trapezoidal in shape.

2. The antenna as claimed in claim 1, wherein the length of the radiating strip is in a range of about 25 mm to 100 mm.

3. The antenna as claimed in claim 1, wherein the base strip is at a distance of 2 mm from the radiating strip.

4. The antenna as claimed in claim 1, wherein the coupling strip extends laterally from the base strip to form a point of contact with the radiating strip.

5. The antenna as claimed in claim 1, further comprising an additional coupling strip further extending laterally and having one end in contact with the base strip.

6. The antenna as claimed in claim 5, wherein the other end of the additional coupling strip forms a point of contact with the radiating strip.

7. A communication device comprising:
- a metallic chassis
- an antenna housed within the metallic chassis, wherein the antenna further comprises:
  - a longitudinally extending base strip;
  - a radiating strip, extending longitudinally with respect to the base strip, wherein the radiating strip is disposed at a specific distance from surface of the metallic chassis; and
  - a plurality of coupling strips, wherein each of the coupling strips provides a conducting path between the base strip and the radiating strip, wherein length of radiating strip is greater than length of the base strip,
  - wherein the specific distance between the radiating strip and the surface of the metallic chassis ranges from 0.1 mm to 0.5 mm.

8. The communication device as claimed in claim 7, wherein each of the plurality of coupling strips is trapezoidal in shape.

9. The communication device as claimed in claim 7, wherein one coupling strip from amongst the plurality of coupling strips extends laterally from the base strip to form a point of contact with the radiating strip.

10. The communication device as claimed in claim 7, wherein another coupling strip from amongst the plurality of coupling strips further extends laterally with one end in contact with the base strip.

11. An antenna for a communication device, the antenna comprising:
- a longitudinally extending base strip;
- a radiating strip, extending longitudinally with respect to the base strip, wherein length of the radiating strip is greater than length of the base strip; and
- an intermediate portion positioned between the base strip and the radiating strip,
- wherein the intermediate portion is in contact with one of the radiating strip and base strip,
- wherein the intermediate portion is a triangular shape or a semi-circular shape with an edge of the intermediate portion positioned proximal to the radiating strip.

12. The antenna as claimed in claim 11, wherein the intermediate portion comprises:
- a lateral portion extending orthogonally from the base strip; and
- a longitudinal portion coupled to the lateral portion, wherein the longitudinal portion extends in the direction of the radiating strip.

13. The antenna as claimed in claim 11, wherein an end proximal to the base strip converges to a point on the base strip.

14. The antenna as claimed in claim 11, wherein an arced edge of the intermediate portion lies proximal to the radiating strip.

* * * * *